US007017646B2

(12) United States Patent
Balliel et al.

(10) Patent No.: US 7,017,646 B2
(45) Date of Patent: Mar. 28, 2006

(54) METHOD FOR CASTING A DIRECTIONALLY SOLIDIFIED ARTICLE

(75) Inventors: Martin Balliel, Bassersdorf (CH); Dietrich Eckardt, Ennetbaden (CH); Maxim Konter, Klingnau (CH); Andreas Weiland, Neucuâtel (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 10/982,957

(22) Filed: Nov. 8, 2004

(65) Prior Publication Data

US 2005/0103462 A1 May 19, 2005

(30) Foreign Application Priority Data

Nov. 6, 2003 (EP) ..... 03104109

(51) Int. Cl.
*B22D 27/04* (2006.01)

(52) U.S. Cl. ..... 164/122.1; 164/122.2

(58) Field of Classification Search ..... 164/122.1, 164/122.2

See application file for complete search history.

(56) References Cited

U.S. PATENT DOCUMENTS 3,532,155 A 10/1970 Skokie et al.
3,690,367 A 9/1972 Daniels
3,763,926 A 10/1973 Tschinkel et al.
3,897,815 A 8/1975 Smashey
5,168,916 A 12/1992 Doriath et al.
5,921,310 A * 7/1999 Kats et al. ..... 164/61
6,868,893 B1 * 3/2005 Shimohata et al. ..... 164/122.1

FOREIGN PATENT DOCUMENTS

EP 0 749 790 A1 12/1996
EP 1 076 118 A1 2/2001

OTHER PUBLICATIONS

Search Report from EP 03 10 4109 (Mar. 24, 2004).

* cited by examiner

*Primary Examiner*—Kuang Y. Lin
(74) *Attorney, Agent, or Firm*—Cermak & Kenealy, LLP; Adam J. Cermak

(57) ABSTRACT

A method of casting a directionally solidified (DS) or single crystal (SX) article with a casting furnace having a heating chamber (4), a cooling chamber (5), a separating baffle (3) between the both chambers includes a first step in which the shell mould (12) is filled with liquid metal (15), and the liquid metal (15) is directionally solidified by withdrawing the shell mould (12) from the heating to the cooling chamber (4, 5). An inert gas impinges from nozzles (8) arranged below the baffle (3) on the shell mould (12) and in steep transitions in outer surface area of the shell mould (12) the flow of the inert gas (9) is reduced or even stopped and when a protruding geometrical feature has passed the impingement area of the gas jets, the gas flow (9) is restored to a value adjusted to the geometry of the cast part presently passing the impingement area.

7 Claims, 2 Drawing Sheets

METHOD FOR CASTING A DIRECTIONALLY SOLIDIFIED ARTICLE

This application claims priority to European application number 03104109.8, filed 6 Nov. 2003, the entirety of which is incorporated by reference herein.

FIELD OF INVENTION

The invention relates to a method for casting a directionally solidified (DS) or single crystal (SX) article.

BACKGROUND OF THE INVENTION

The invention proceeds from a process for producing a directionally solidified casting and from an apparatus for carrying out the process as is described, for example, in U.S. Pat. No. 3,532,155. The process described serves to produce the guide vanes and rotor blades of gas turbines and makes use of a furnace which can be evacuated. This furnace has two chambers which are separated from one another by a water-cooled wall and are arranged one above the other, the upper chamber of which is designed so that it can be heated and has a pivotable melting crucible for receiving material to be cast, for example a nickel base alloy. The lower chamber, which is connected to this heating chamber by an opening in the water-cooled wall, is designed so that it can be cooled and has walls through which water flows. A driving rod which passes through the bottom of this cooling chamber and through the opening in the water-cooled wall bears a cooling plate through which water flows and which forms the base of a casting mould located in the heating chamber.

When carrying out the process, first of all the alloy which has been liquefied in the melting crucible is poured into the casting mould located in the heating chamber. A narrow zone of directionally solidified alloy is thus formed above the cooling plate forming the base of the mould. As the casting mould is moved downwards into the cooling chamber, this mould is guided through the opening provided in the water-cooled wall. A solidification front which delimits the zone of directionally solidified alloy migrates from the bottom upwards through the entire casting mould, forming a directionally solidified casting.

A further process for producing a directionally solidified casting is disclosed in U.S. Pat. No. 3,763,926. In this process, a casting mould filled with a molten alloy is gradually and continuously immersed into a tin bath heated to approximately 260° C. This achieves a particularly rapid removal of heat from the casting mould. The directionally solidified casting formed by this process is distinguished by a microstructure which has a low level of inhomogeneities. When producing gas turbine blades of comparable design, it is possible using this process to achieve $\alpha$ values which are almost twice as high as when using the process according to U.S. Pat. No. 3,532,155. However, in order to avoid unwanted gas-forming reactions, which can damage the apparatus used in carrying out this process, this process requires a particularly accurate temperature control. In addition, the wall thickness of the casting mould has to be made larger than in the process according to U.S. Pat. No. 3,532,155.

U.S. Pat. No. 5,168,916 discloses a foundry installation designed for the fabrication of metal parts with an oriented structure, the installation being of a type comprising a casting chamber communicating with a lock for the introduction and extraction of a mould, via a first opening sealable by a first airtight gate apparatus for casting and for cooling the mould placed in the chamber. In accordance with the invention, the installation includes, in addition, a mould preheating and degassing chamber communicating with the lock via a second opening sealable by a second airtight gate.

U.S. Pat. No. 5,921,310 discloses a process which serves to produce a directionally solidified casting and uses an alloy located in a casting mould. The casting mould is guided from a heating chamber into a cooling chamber. The heating chamber is here at a temperature above the liquidus temperature of the alloy, and the cooling chamber is at a temperature below the solidus temperature of the alloy. The heating chamber and the cooling chamber are separated from one another by a baffle, aligned transversely to the guidance direction, having an opening for the casting mould. When carrying out the process, a solidification front is formed, beneath which the directionally solidified casting is formed. The part of the casting mould which is guided into the cooling chamber is cooled with a flow of inert gas. As a result, castings which are practically free of defects are achieved with relatively high throughput times. However, the quality of complex shaped castings such as turbine blades and vanes with protruding geometrical features, e.g. a shroud, platform or fin, will suffer from a heat flux which is not aligned to the vertical withdrawal direction, when the flow of inert gas impinges on such protruding features causing an excessive cooling due to the steep increase in outer surface area associated with a protruding feature. In directionally solidified polycrystals (DS) this causes undesired inclined DS grain boundaries, and for both, DS and single crystal (SX) articles the risk for undesired stray grains is increased. Furthermore, the vector component of the thermal gradient which is aligned to the vertical withdrawal direction is decreased, as a portion of the heat flux is not aligned with the vertical direction and therefore does not contribute to establish the vertical thermal gradient. Consequently the process does not achieve an optimum thermal gradient in vertical direction and therefore there is a risk for undesired freckles (chain of small stray grains, which may occur in particular in thick sections of a casting). Furthermore, the dendrite arm spacing is roughly inversely proportional to the square root of the thermal gradient, so the dendrite arm spacing is increased by decreasing the thermal gradient. This means that the distance from a dendrite stem to an adjacent interdendritic area is increased, which increases the amount of interdendritic segregation (e.g. diffusion has to overcome a larger distance). This may cause undesired incipient melting during a subsequent solutioning heat treatment, which is required for almost all of today's Nickel-base SX and DS superalloys. Additionally, an increased dendrite arm spacing increases the interdendritic spaces, where pores may form, and therefore causes an undesired increase in pore size.

SUMMARY OF THE INVENTION

One aspect of the present invention includes a method for manufacturing one or more directionally solidified (DS) or single crystal (SX) articles which avoids a direction of the heat flux which deviates substantially from the vertical withdrawal direction at protruding geometrical features of the cast part while increasing the thermal gradient in the vertical withdrawal direction within the cast part.

When a protruding geometrical feature, which means a steep increase in outer surface area, like a shroud passes the impingement area of the gas jets, the inert gas flow is reduced or even stopped to prevent excessive cooling and to prevent a heat flux direction in the cast part which deviates from the vertical withdrawal direction. Such a deviating heat flux direction causes an inclined solidification front, which in turn can cause undesired inclined DS grain boundaries or stray grain formation in both, DS and SX. When such a protruding geometrical feature has passed the impingement area of the gas jets, the inert gas flow is restored to a value adjusted to the geometry of the cast part presently passing the impingement area.

Advantageously the patches of heat extraction generated by gas nozzles are positioned at a constant height below the baffle and around the circumference of the cast parts in the mould cluster, so they form continuous or mostly continuous rings around the cast parts and therefore establish a good homogeneity of heat extraction, which in turn promotes a desired flat and horizontal solidification front.

Additional to the gas background pressure setting, the gas composition can be selected to achieve an optimum heat transfer by the gas nozzles, by filling the gap at the interface between the shell mould and cast metal with gas, by filling open porosity of the shell mould with gas, and by gas convection in the heater and cooling chamber. E.g. Helium is known to transfer substantially more heat than Argon, so varying the ratio of both gases provides a substantial variation in heat transfer. However, in general the inert gas can consist of a given mixture of different noble gases and/or nitrogen. Generally, such an increase in heat transfer is beneficial as long as it leads to an increased heat flux in vertical direction through the cast parts, thereby a higher thermal gradient and consequently benefits for the grain structure.

Closing mechanical gas flow connections between the heating and cooling chamber during the withdrawal of the shell mould minimizes detrimental convection between the heater and cooling chamber.

BRIEF DESCRIPTION OF THE DRAWINGS

Exemplary embodiments of the invention are illustrated in the accompanying drawings, in which.

The drawings show only the elements important for the invention. Same elements will be numbered in the same way in different drawings.

DETAILED DESCRIPTION OF EXEMPLARY EMBODIMENTS OF THE INVENTION

Figure 1:
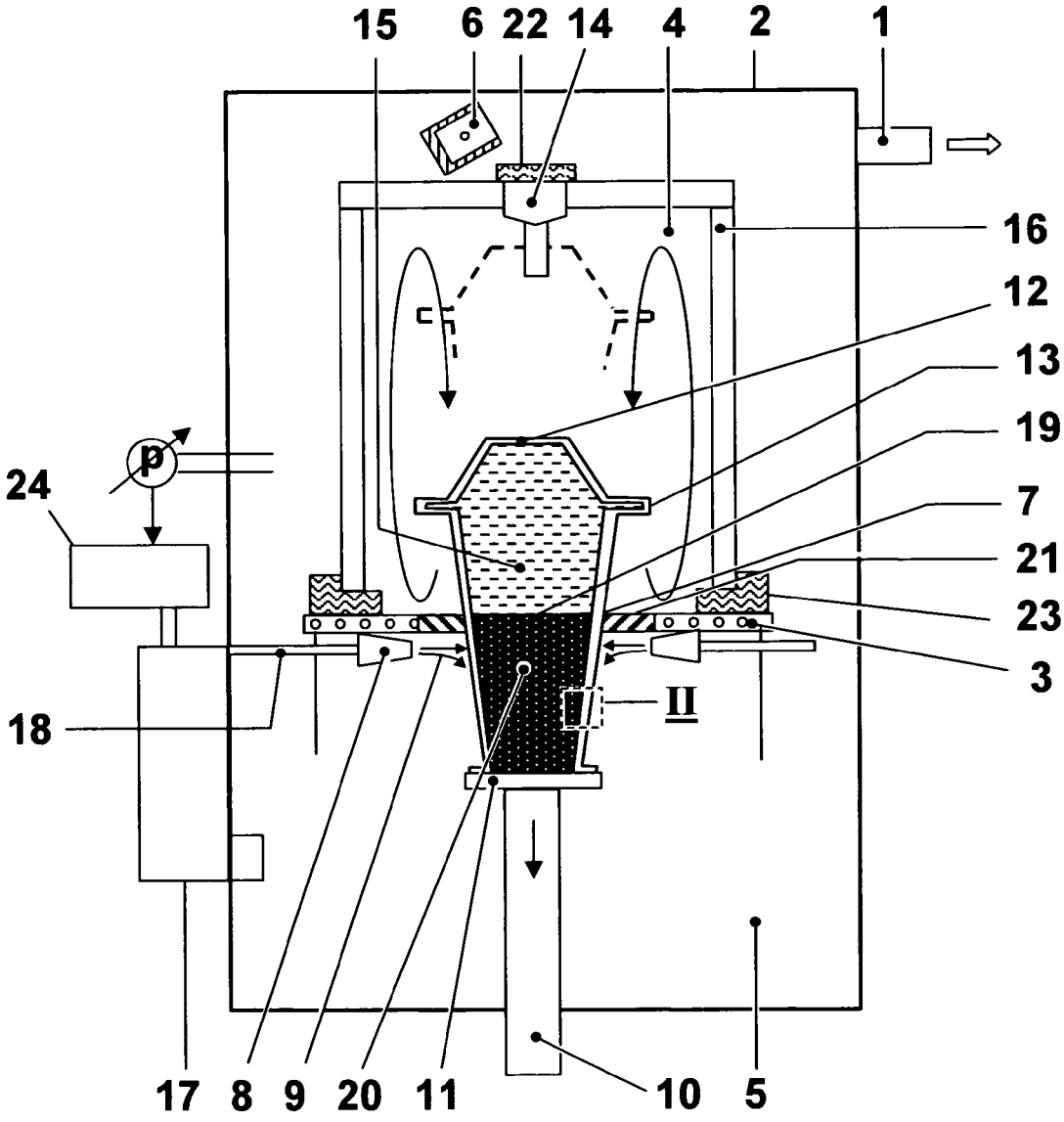
FIG. 1 shows a schematic view of an exemplary embodiment of an apparatus for carrying out the method according to the invention and FIG. 2 illustrates a shell mould having an open porosity (detail II of FIG. 1).

The invention of casting directionally solidified (DS) or single crystal (SX) articles such as blades or vanes or other parts of gas turbine engines is described in greater detail below with reference to an exemplary embodiment. In this case, FIG. 1 shows in diagrammatic representation an exemplary embodiment of an apparatus for carrying out the process according to the present invention. The apparatus shown in FIG. 1 has a vacuum chamber 2 which can be evacuated by means of a vacuum system 1. The vacuum chamber 2 accommodates two chambers 4, 5 which are separated from one another by a baffle (radiation and gas flow shield) 3, which may be extended with flexible fingers or brushes 21, and are arranged one above the other, and a pivotable melting crucible 6 for receiving an alloy, for example a nickel base superalloy. The upper one 4 of the two chambers is designed so that it can be heated. The lower chamber 5, which is connected to the heating chamber 4 through an opening 7 in the baffle 3, contains a device for generating and guiding a stream of gas. This device contains a cavity with orifices or nozzles 8, which point inwardly onto a casting mould 12, as well as a system for generating gas flows 9. The gas flows emerging from the orifices or nozzles 8 are predominantly centripetally guided. A driving rod 10 passing for example through the bottom of the cooling chamber 5 bears a cooling plate 11, through which water may flow if appropriate and which forms the base of a casting shell mould 12. By means of a drive acting on the driving rod 10, this casting shell mould 12 can be guided from the heating chamber 4 through the opening 7 into the cooling chamber 5.

Above the cooling plate 11, the casting shell mould 12 has a thin-walled part 13, for example 10 mm thick, made of ceramic, which can accommodate at its bottom end towards the cooling plate 11 one or several single crystal seeds promoting the formation of single crystal articles and/or one or several helix initiators. By being lifted off from the cooling plate 11 or being put down on the cooling plate 11, the casting shell mould 12 can be opened or closed, respectively. At its upper end, the casting shell mould 12 is open and can be filled with molten alloy 15 from the melting crucible 6 by means of a filling device 14 inserted into the heating chamber 4. Electric heating elements 16 surrounding the casting shell mould 12 in the heating chamber 4 keep that part of the alloy which is located in the part of the casting shell mould 12 on the heating chamber 4 side above its liquidus temperature.

The cooling chamber 5 is connected to the inlet of a vacuum system 17 for removing the inflowing gas from the vacuum chamber 2 and for cooling and purifying the gas removed.

In order to produce a directionally solidified casting, first of all the casting shell mould 12 is brought into the heating chamber 4 by an upwards movement of the driving rod 10 (shown in dashed lines in FIG. 1). Alloy which has been liquefied in the melting crucible 6 is then poured into the casting shell mould 12 by means of the filling device 14. A narrow zone of directionally solidified alloy is thus formed above the cooling plate 11 which forms the base of the mould (not shown in the FIG. 1).

As the casting shell mould 12 moves downwards into the cooling chamber 5, the ceramic part 13 of the casting shell mould 12 is successively guided through the opening 7 provided in the baffle 3. A solidification front 19 which delimits the zone of directionally solidified alloy migrates from the bottom upwards through the entire casting shell mould 12, forming a directionally solidified casting 20.

At the start of the solidification process, a high temperature gradient and a high growth rate of solid are achieved, since the material which is poured into the shell mould 12 initially strikes the cooling plate 11 directly and the heat which is to be removed from the melt is led from the solidification front through a comparatively thin layer of solidified material to the cooling plate 11. When the base of the casting shell mould 12, formed by the cooling plate 11, has penetrated a few millimeters, for example 5 to 50 mm, measured from the underside of the baffle 3, into the cooling chamber 5, inert compressed gas which does not react with the heated material, for example a noble gas, such as helium or argon, or another inert fluid is supplied from the orifices or nozzles 8. The inert gas flows emerging from the orifices or nozzles 8 impinge on the surface of the ceramic part 13 and are led away downwards along the surface. In the process, they remove heat q from the casting shell mould 12 and thus also from the already directionally solidified part of the casting shell mould content.

The inert gas blown into the cooling chamber 5 can be removed from the vacuum chamber 2 by the vacuum system 17, cooled, filtered and, once it has been compressed to a few bar, fed to pipelines 18 which are operatively connected to the orifices or nozzles 8.

In addition to a ramp up of the inert gas flow 9 after initial 5–50 mm withdrawal as mentioned in U.S. Pat. No. 5,921,310, a time-controlled flow of cooling gas adapted to geometrical features of the casting and shell mould 12, e.g. shroud, platform, fins and steep transitions in outer surface area. When a protruding geometrical feature, which means a steep increase in outer surface area, like a shroud passes the impingement area of the gas jets, the inert gas flow 9 is reduced or even stopped to prevent excessive cooling and to prevent a heat flux direction in the cast part which deviates from the vertical withdrawal direction. Such a deviating heat flux direction causes an inclined solidification front, which in turn can cause undesired inclined DS grain boundaries or stray grain formation. When such a protruding geometrical feature has passed the impingement area of the gas jets, the inert gas flow 9 is restored to a value adjusted to the geometry of the cast part presently passing the impingement area.

The gas nozzles 8 in combination with the baffle 3, which acts as a deflector of the inert gas flow 9, are aligned in a way that the gas flows along the surface of the shell mould 12 is predominantly downwards to distribute heat extraction more equally and downwards. Furthermore, this establishes a well-defined upward border of heat extraction in an area below the baffle 3 to maximize the thermal gradient.

Control the overall cooling gas flow 9 and gas pump out rate to achieve an optimum controlled background gas pressure in the chamber with a controlling device 24. A good quality can be achieved within a pressure range of the inert gas of 10 mbar to 1 bar. This background gas pressure is selected for an increased and optimum heat transfer between the shell mould 12 and the cast metal, thereby increases both, the heat extraction in the cooling chamber 5 and heat input in the heater chamber 4, so overall a higher thermal gradient is achieved. Furthermore, the background pressure helps to homogenize heat extraction by the gas jets around the circumference of the cast parts in the shell mould cluster, because it disperses the gas jets to a certain degree so they cover a defined larger mould area.

These defined larger mould areas or patches of heat extraction, one per nozzle 8, can be positioned on the shell mould 12 surface by positioning and aligning the corresponding nozzles 8 and adjusting the gas flow rate, e.g. by a throttle. Advantageously the patches of heat extraction are positioned at a constant height below the baffle 3 and around the circumference of the cast parts in the mould cluster, so they form continuous or mostly continuous rings around the cast parts and therefore establish a good homogeneity of heat extraction, which in turn promotes a desired flat and horizontal solidification front. Consequently, in DS polycrystals the grain boundaries are well aligned in vertical direction and the risk for stray grain formation in both, DS polycrystals and single crystals (SX) is reduced. Additionally, the increased thermal gradient reduces freckle formation.

Additional to the gas background pressure setting, the gas composition can be selected to achieve an optimum heat transfer by the gas nozzles 8, by filling the gap 12*b* at the interface between the shell mould 12 and cast metal with gas, by filling open porosity of the shell mould 12 with gas, and by gas convection in the heater and cooling chamber 4, 5 (as indicated by arrows in FIG. 1). E.g. Helium is known to transfer substantially more heat than Argon, so varying the ratio of both gases provides a substantial variation in heat transfer. However, in general the inert gas can consist of a given mixture of different noble gases and/or nitrogen. The resulting increase in heat transfer is beneficial as long as it leads to an increased heat flux in vertical direction through the cast parts, thereby a higher thermal gradient and consequently benefits for the grain structure.

A potential drawback of the background gas pressure is gas convection between the heater and cooling chamber 4, 5, which causes a reduced cooling in the cooling chamber 5 and reduced heating in the heater chamber 4, thereby decreasing the thermal gradient in the cast parts. To minimise such detrimental convection any gas flow connections between the heater and cooling chamber 4, 5 are closed as much as possible. In particular, the shape of the baffle 3 is constructed to minimize the gap between the baffle's 3 inward facing contour and the shell mould 12, and the baffle 3 is advantageously extended towards the surface of the shell mould 12, e.g. by fibers, brushes or flexible fingers 21. Additionally, a seal 23 between the baffle 3 and the heating element 16, as well as during the withdrawal of the shell mould 12 a movable lid 22 of the filling device close any gas flow connections between the heating and cooling chamber 4, 5. If the heating element 16 is not a closed construction, e.g. it contains openings where gas could flow through, a gas flow seal to close such openings is added at the outward surface of the heating element 16.

Figure 2:
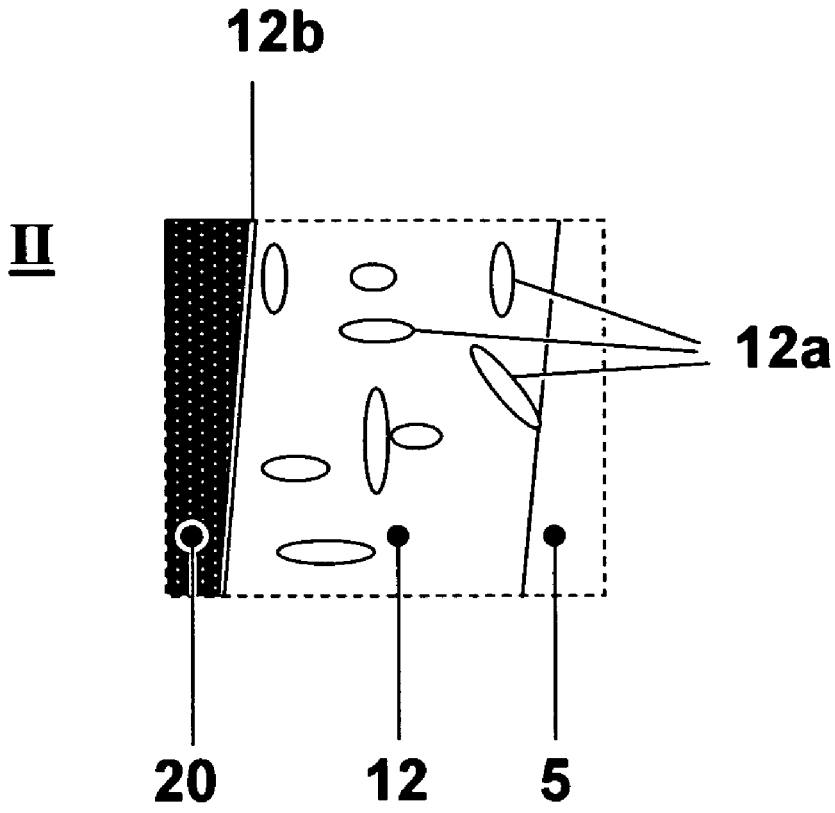

Furthermore, the properties of the shell mould 12 can be adapted to achieve an optimum heat transfer, e.g. amount of porosity and wall thickness (see FIG. 2 where the detail II of FIG. 1 with a shell mould 12 having an open porosity with pores 12*a* is shown). Increasing the mould's porosity increases the effect of gas on the thermal diffusivity of the mould 12 as more or larger pores are filled with gas. Decreasing the mould's wall thickness increases the heat transfer through the shell mould 12. A higher thermal diffusivity of the shell mould 12 and a higher heat transfer through the shell mould 12 are beneficial as they increase both, heat extraction in the cooling chamber 5 and heat input in the heater chamber 4, thereby increasing the thermal gradient in the cast part with beneficial effects as described before. For the present invention a shell mould 12 with an average thickness of two thirds of the conventionally used thickness of the shell mould 12 with a range of ±1 mm can be used.

While the present invention has been described by an example, it is apparent that other forms could be adopted by one skilled in the art. Accordingly, the scope of our invention is to be limited only by the attached claims. The entirety of each of the aforementioned documents is incorporated by reference herein.

REFERENCE NUMBERS

1 Vacuum system
2 Vacuum chamber
3 Baffle (radiation and gas flow shield)
4 Heating chamber
5 Cooling chamber
6 Melting crucible
7 Opening
8 Nozzle
9 Inert gas flow
10 Driving rod
11 Cooling plate

12 Casting shell mould
12*a* Pore within shell mould 12
12*b* Gap
13 Ceramic part
14 Filling device
15 Molten alloy
16 Heating element
17 Vacuum system
18 Pipelines
19 Solidification front
20 Casting
21 Flexible fingers or brushes
22 Movable lid
23 Seal
24 Controlling Device

What is claimed is:

1. A method of casting a directionally solidified (DS) or single crystal (SX) article with a casting furnace having a heating chamber with at least one heating element, a cooling chamber, and a separating baffle between the heating and the cooling chamber, the method comprising:

feeding the shell mould within the heating chamber with liquid metal through a filling device;

withdrawing the shell mould from the heating chamber through the baffle to the cooling chamber and thereby directionally solidifying the liquid metal forming the cast article;

after withdrawing an initial 5–50 mm of the shell mould into the cooling chamber, impinging an inert gas from nozzles arranged below the baffle on the shell mould and thereby forming an impingement area;

at least reducing, in steep increase in outer surface area or a protruding geometrical feature of the shell mould, the flow of the inert gas; and when the steep increase or protruding geometrical feature has passed the impingement area of the gas jets, restoring the gas flow to a value adjusted to the geometry of the cast part presently passing the impingement area.

2. The method of claim 1, further comprising:

directing the gas flow around the circumference of at least one article in the shell mould cluster in a homogeneous manner at a constant height below the baffle.

3. The method of claim 1, comprising:

directing the gas flow downwards along the shell mould surface.

4. The method of claim 1, further comprising:

casting the article in the casting furnace having a controlled background pressure of the inert gas.

5. The method of claim 1, further comprising:

casting the article in the casting furnace with an inert gas comprising a mixture of different noble gases, and/or nitrogen.

6. The method of claim 1, further comprising:

closing mechanical gas flow connections between the heating and cooling chamber during said withdrawing of the shell mould with a baffle having flexible fingers or brushes towards the shell mould, by closing the filling device with a movable lid and by a seal between the baffle and the heating element.

7. The method of claim 1, further comprising:

casting the article in a shell mould with a controlled open porosity having pores which are filled with the inert gas.

* * * * *

UNITED STATES PATENT AND TRADEMARK OFFICE

CERTIFICATE OF CORRECTION

PATENT NO. : 7,017,646 B2
APPLICATION NO. : 10/982957
DATED : March 28, 2006
INVENTOR(S) : Balliel, Martin It is certified that error appears in the above-identified patent and that said Letters Patent is hereby corrected as shown below:

Title page,
Item [75], Inventor, should read -- Andreas Weiland, Neuchâtel (CH) --.

Signed and Sealed this

Fourth Day of July, 2006

JON W. DUDAS
*Director of the United States Patent and Trademark Office*